US008701217B2

(12) United States Patent
Cassoli

(10) Patent No.: US 8,701,217 B2
(45) Date of Patent: Apr. 22, 2014

(54) UNDERGARMENT

(75) Inventor: Stefano Cassoli, Bologna (IT)

(73) Assignee: Sidney S.R.L., Bologna (IT)

( * ) Notice: Subject to any disclaimer, the term of this patent is extended or adjusted under 35 U.S.C. 154(b) by 0 days.

(21) Appl. No.: 13/640,816

(22) PCT Filed: Apr. 15, 2011

(86) PCT No.: PCT/IB2011/051633

§ 371 (c)(1),
(2), (4) Date: Dec. 18, 2012

(87) PCT Pub. No.: WO2011/128874

PCT Pub. Date: Oct. 20, 2011

(65) Prior Publication Data

US 2013/0198940 A1 Aug. 8, 2013

(30) Foreign Application Priority Data

Apr. 16, 2010 (IT) ..... B02010A0239
Jan. 25, 2011 (IT) ..... BO2011A0024

(51) Int. Cl.
*A41B 9/00* (2006.01)

(52) U.S. Cl.
USPC ..... 2/401

(58) Field of Classification Search
USPC ..... 66/170, 175, 177, 178, 171; 2/239–242, 2/400, 401, 73, 78.1, 78.3; 450/115–118, 450/130–132
See application file for complete search history.

(56) References Cited

U.S. PATENT DOCUMENTS

| | | | | |
|---|---|---|---|---|
| 3,413,824 | A * | 12/1968 | Kuney | 66/177 |
| 4,325,379 | A * | 4/1982 | Ozbey | 450/116 |
| 5,590,548 | A | 1/1997 | Osborne | |
| 5,611,722 | A | 3/1997 | Osborne | |
| 6,430,753 | B2 * | 8/2002 | Duran | 2/239 |
| 6,651,463 | B2 * | 11/2003 | Bonnin | 66/177 |
| 6,728,973 | B1 * | 5/2004 | Webley et al. | 2/400 |
| 6,874,337 | B2 * | 4/2005 | Uno et al. | 66/177 |
| 7,143,453 | B2 * | 12/2006 | Duran | 2/409 |
| 7,260,961 | B1 * | 8/2007 | Kennedy et al. | 66/177 |
| 7,509,822 | B2 * | 3/2009 | Ishida et al. | 66/177 |
| 7,526,929 | B2 * | 5/2009 | Takamoto et al. | 66/177 |
| 8,235,765 | B2 * | 8/2012 | Falla | 450/114 |
| 8,397,314 | B2 * | 3/2013 | Burke | 2/408 |
| 2004/0016043 | A1 | 1/2004 | Uno et al. | |
| 2004/0111781 | A1 | 6/2004 | Miyake et al. | |
| 2005/0022894 | A1 | 2/2005 | Shannon | |
| 2006/0174963 | A1 | 8/2006 | Shannon | |
| 2011/0023216 | A1 | 2/2011 | O'Leary | |

FOREIGN PATENT DOCUMENTS

GB 2 458 210 A 9/2009

* cited by examiner

*Primary Examiner* — Danny Worrell
(74) *Attorney, Agent, or Firm* — Pearne & Gordon LLP

(57) ABSTRACT

A men's undergarment (1) comprises an upper portion (2) looped to encircle the waist of a wearer; a front portion supported by the upper portion (2) and extending downwards from it; a rear area (5), extending downwards from the upper portion (2) and connected to the front portion, with which it forms a first and a second opening (6, 7) for the legs of the wearer; the rear area comprising a portion (5*a*, 5*b*, 5*c*) made of elastic fabric and comprising a system (9) for confining the elastic stretching of the rear portion (5*a*, 5*b*, 5*c*); the elastic stretching confining system comprising at least one sector (14) in the rear area (5) where stretching is reduced compared with the stretching of the remaining part of the rear area (5).

12 Claims, 3 Drawing Sheets

UNDERGARMENT

TECHNICAL FIELD

This invention relates to a men's undergarment and in particular to men's briefs or underpants or boxer shorts.

BACKGROUND ART

There is a plurality of prior art men's undergarments, for example made of linen, cotton, wool or other materials, which are worn against the skin.

In the following description, for simplicity, explicit reference is made to briefs, without thereby limiting the scope of the invention.

At present, as a result of the development of new materials and fabrics, briefs made of elastic or partly elastic material, commonly known as "stretch" are particularly widespread.

In general, such briefs have an upper portion, comprising a looped elastic element, to be worn around the waist, at least one front portion, supported by the upper portion, and a rear area also supported by the upper portion and connected to the front portion.

Prior art briefs comprise a lower portion, designed to cover the crotch of the wearer, which connects the front portion and rear area.

Once the briefs have been put on, as indicated, the upper portion encircles the waist of a wearer, the front portion covers the genitals and the rear area, usually made in one piece, covers the buttocks.

One problem with prior art briefs made of stretch material is that they do not adapt in the optimum way to the body of the wearer.

That problem particularly affects the rear part which, being made in a single piece with uniform elasticity all over, has trouble adhering in a uniform way to the buttocks of the wearer, with unsatisfactory aesthetic results.

Moreover, prior art undergarments are not particularly comfortable due to the uniform elasticity of the rear area.

DISCLOSURE OF THE INVENTION

In this context, the main technical purpose of this invention is to provide a men's undergarment which overcomes the above-mentioned disadvantages.

One aim of this invention is to provide a men's undergarment, for example underpants or briefs, which provides an optimum fit for the wearer even at the rear part, that is to say, at the buttocks of the wearer.

Another aim of this invention is to provide a men's undergarment which, once put on, offers a pleasant aesthetic result in particular at the rear part.

Yet another aim is to provide a men's undergarment which is more comfortable than the prior art undergarments.

The technical purpose indicated and the aims specified are substantially achieved by an undergarment according to claim 1 and one or more of the dependent claims.

BRIEF DESCRIPTION OF THE DRAWINGS

Further features and advantages of the invention are more apparent in the non-limiting description which follows of a preferred non-limiting embodiment of an undergarment illustrated in the accompanying drawings, in which.

DETAILED DESCRIPTION OF THE PREFERRED EMBODIMENTS OF THE INVENTION

With reference to the accompanying drawings, the numeral 1 denotes a men's undergarment according to this invention.

In the examples illustrated, the undergarment 1 is in the form of briefs, however, in alternative embodiments, the undergarment 1 is in the form of boxers or underpants or the like.

Figure 1:
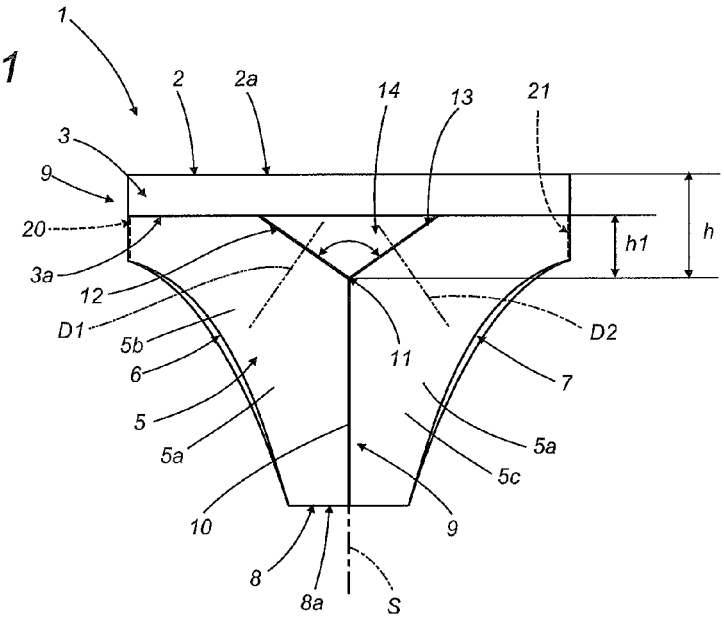
FIG. 1 is a schematic rear view of a first embodiment of an undergarment according to this invention.

As illustrated, for example in FIG. 1, the undergarment 1 comprises a looped upper portion 2.

The portion 2 comprises at least one elastic element 3, also looped, and is designed to be worn around the waist of a generic wearer, not illustrated.

A front portion, not visible, is supported by the upper portion 2 and extends downwards from it, with reference to the Figure and in practice.

The undergarment 1 comprises a rear area or zone 5 supported by the upper portion 2 and connected to the front portion.

In the preferred embodiment illustrated, the undergarment 1 comprises a first and a second seam 20, 21 between the front portion and the rear area 5.

Preferably, the seams 20, 21 extend vertically and are parallel with each other and positioned symmetrically relative to a middle section S of the undergarment 1.

The rear area 5 extends downwards from the upper portion 2 and, together with the front portion, delimits a first and a second opening 6, 7 for the legs of the wearer.

The front portion and the rear area 5 are preferably connected to each other at the bottom, at the crotch 8 of the undergarment 1 which also acts as a separator between the first and second openings 6 and 7.

Even more preferably, the briefs 1 comprise a lower portion 8*a* connecting the front portion with the rear area 5 which forms a reinforcement of the undergarment 1 at the crotch 8.

Of particular interest for this solution for an undergarment is the rear area 5, whilst the upper portion 2, the front portion and the lower portion 8*a* will not be described in detail, since they are of the substantially known type.

The rear area 5 comprises a main portion or zone 5*a* made of stretchable material, for example and preferably stretch or other elastic fabric.

In other words, the portion 5*a* is of the type which stretches elastically, that is to say, modifies its dimensions, increasing them, when pulled.

In the specific case, the portion 5*a* deforms, stretching, when put on by the wearer.

The undergarment 1 comprises a system 9 for confining the elastic deformation of the portion 5*a*.

The confining system 9 defines zones in the rear portion 5*a* where elastic deformation is prevented or significantly reduced compared with the rest of the portion 5*a*.

Preferably, the confining system 9 constrains the fabric of the portion 5*a* so that it only deforms according to predetermined preferred directrices or lines D1 and D2 with reference, for example, to FIG. 1.

In the preferred embodiments illustrated, the system 9 comprises the seams 20, 21 which effectively confine the elasticity due to the portion 5*a* to only the rear area 5 of the undergarment 1.

With reference to the accompanying drawings, it should be noticed that the system 9 comprises a seam 10, vertical when observing the accompanying drawings, which extends, in the middle section S of the portion 5*a*.

The seam 10 preferably extends between the crotch 8 and a node 11.

The seam 10 preferably extends from the crotch 8 to the node 11.

In the preferred embodiments illustrated, the seam 10 joins two half-portions 5*b*, 5*c* which as a whole form the rear portion 5*a*.

The system 9 for confining the elastic stretching is active on the portions 5*b*, 5*c* and comprises at least one sector 14 in the rear area 5 where stretching is reduced compared with the portion 5*a* made of elastic fabric.

As is described in more detail below, with reference to the examples illustrated, the node 11 forms a point of intersection for elements belonging to the confining system 9.

Advantageously, for optimum wearability, the node 11 is positioned at a predetermined distance "h1" measured from the lower edge 3*a* of the upper elastic element 3.

Advantageously, in other embodiments, the positioning of the node 11 is measured by means of a height "h" from the upper profile 2*a* of the undergarment 1, that is to say, from the upper profile 2*a* of the upper portion.

As illustrated, the distance "h1" is preferably greater than or equal to 3 cm and less than or equal to 12 cm, that is to say:

$$3 \leq h1 \leq 12.$$

As illustrated in the accompanying drawings, the confining system 9 comprises a second and a third stiffening segment 12, 13, that is to say, segments in which elastic deformation is appropriately reduced compared with the elastic deformation of the portion 5*a*.

Said segments 12 and 13 are preferably formed by corresponding seams provided in the rear area 5.

The segments 12 and 13 more precisely delimit, as described in more detail below, a sector of the undergarment 1 where the elastic stretching is reduced compared with the remaining zones of the rear area 5 of the undergarment 1.

The second and third stiffening segments 12, 13 extend from the node 11 towards the upper portion 2.

As illustrated, the segments or seams 12 and 13 are preferably straight.

The segments 12 and 13 are set at an angle to the section S, that is to say, the section S bisects the angle "α" formed between the segments 12 and 13.

Advantageously, to guarantee optimum wearability for the undergarment 1 on all types of wearers, the angle "α" is greater than or equal to 75 sexagesimal degrees and less than or equal to 170 sexagesimal degrees, that is to say, in numbers:

$$75° \leq \alpha \leq 170°.$$

Preferably, to achieve even better adherence of the elastic portion 5*a* of the undergarment 1 to the buttocks of the wearer, the angle "α" is greater than or equal to 95 sexagesimal degrees and less than or equal to 150 sexagesimal degrees, that is to say, in numbers:

$$95° \leq \alpha \leq 150°.$$

In a first preferred embodiment, the segments or seams 12 and 13 together with the upper portion 2 delimit a closed polygonal portion which forms the sector 14 of the rear area 5 where stretching is reduced compared with the portion 5*a* made of elastic fabric.

More particularly, the closed sector 14 is delimited by the segments 12 and 13 and by the elastic element 3.

In particular, as illustrated by way of example in the accompanying drawings, the sector 14 is substantially triangular.

In alternative embodiments, the portion, that is to say, the sector 14 preferably comprises a polygonal perimeter having any number of sides.

Alternatively, in further alternative embodiments, not illustrated, the sector 14 is delimited by curvilinear seams or the like.

Preferably, the sector 14 is made of a fabric whose modulus of elasticity is less than the modulus of elasticity of the remaining rear area 5 of the undergarment 1, that is to say, the portion 5*a*.

Even more preferably, the sector 14 is made of fabric having a modulus of elasticity which is null, that is to say, equal to 0.

Advantageously, the sector 14 is alternatively formed, in embodiments not illustrated, by a plurality of seams suitably arranged which effectively make it stiffer than the remaining part of the rear area 5, and in particular the portions 5*b* and 5*c*.

Advantageously, in the latter configuration, the sector 14 is alternatively made of elastic fabric, for example like that of the portions 5*b* and 5*c*, or of inelastic fabric or comprises both.

If it is made of elastic fabric, the sector 14 is preferably part of the portion 5*a* made as a single piece.

Alternatively, the sector 14 is stiffened by connecting it to a stiffening frame.

In other words, the rear area 5 of the undergarment 1 comprises the sector 14, for example delimited by the segments 12 and 13 having a predetermined modulus of elasticity or in any case with a susceptibility to stretching in any predetermined way obtained and less than that of the remaining part of the rear area 5, and the portions or zones 5*a* having a modulus of elasticity greater than that of the sector 14.

Preferably, the segments 12 and 13 are formed by seams by means of which the two different fabrics, that is to say, having different stretching features, of the portions 5*a* and the sector 14 are held together.

In practice the undergarment 1 directions of stretching, in particular in the embodiments illustrated in the accompanying drawings, are dictated by the confining system 9 which comprises both the segments or seams 12 and 13 and the sector 14.

In that way and in general for any preferred embodiment of it, once the undergarment 1 has been put on, the sector 14 is subject to less stretching than the remaining area 5.

Advantageously, said differentiated stretching allows the undergarment 1 to fit well on the buttocks of the wearer.

The wearability and comfort of the undergarment 1 are guaranteed by the sector 14 which allows the seam 10 to be subjected to an upward pulling action at the moment when the undergarment 1 is put on, so that it is appropriately positioned on the wearer.

In the examples illustrated in the accompanying drawings, the segments or seams 12 and 13, together with the seam 10, hold together the half-portions 5*b* and 5*c* by means of the sector 14 and as a whole form the rear portion 5*a*.

The half-portions 5*b* and 5*c* can stretch in a differentiated way compared with the sector 14 and guarantee the desired wearability of the undergarment 1.

It should be noticed that the above-mentioned values of the angle "a" and of the height "h1" allow optimisation of the configuration of the confining system 9 depending on the size of the undergarment 1, that is to say, the obtainment of a suitable confinement system 9 depending on the size of the undergarment 1 and therefore of the wearer.

Even more preferably, the above-mentioned values of the angle "α" and of the height "h1" allow optimisation of the configuration of the confining system 9 depending on the physique of the wearer.

The accompanying drawings illustrate, by way of example, preferred embodiments of the undergarment 1 comprising the segments 12, 13 and the seam 10.

In FIG. 1 the angle "α" is 110 sexagesimal degrees and the height "h1" is 55 cm.

Figure 2:
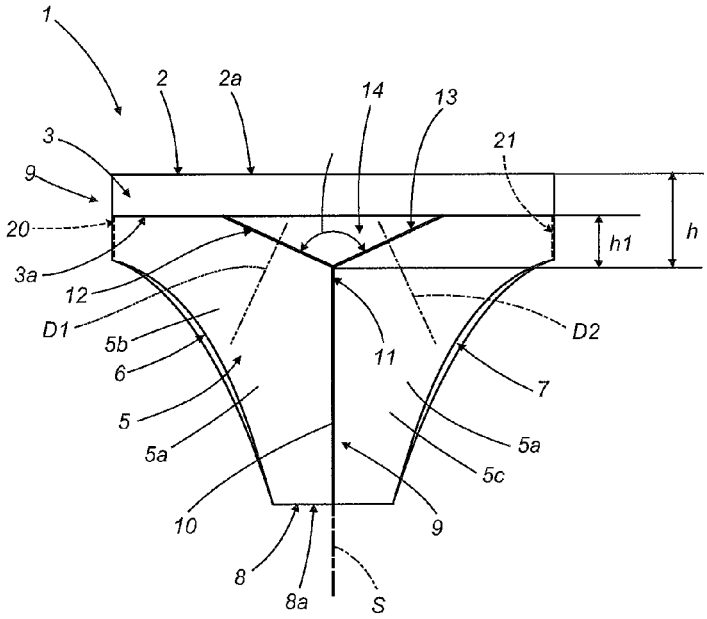
FIG. 2 is a schematic rear view of a second embodiment of an undergarment according to this invention.

In FIG. 2 the angle "α" is 130 sexagesimal degrees and the height "h1" is 45 cm.

Figure 3:
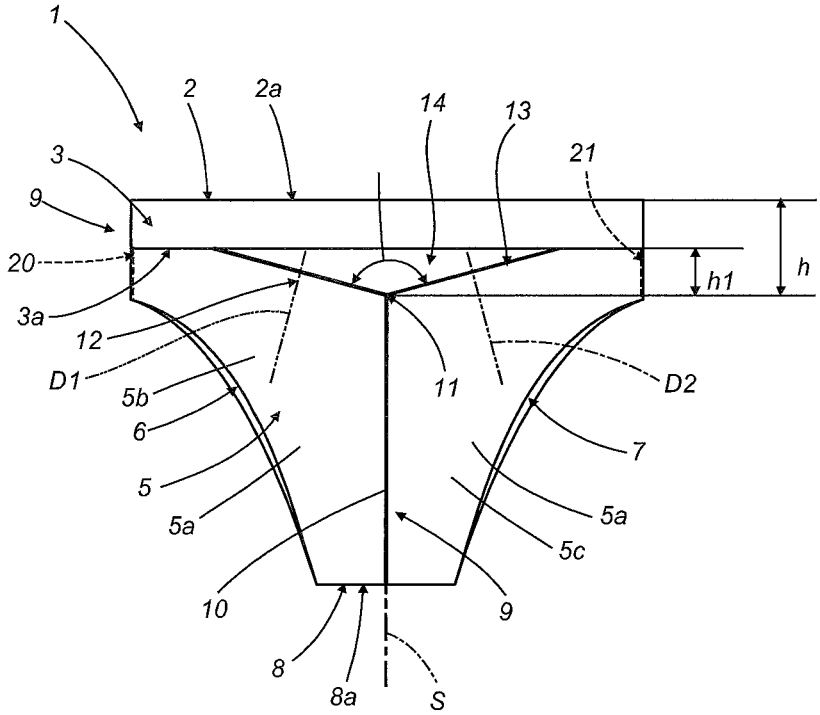
FIG. 3 is a schematic rear view of a third embodiment of an undergarment according to this invention.

In FIG. 3 the angle "α" is 150 sexagesimal degrees and the height "h1" is 35 cm.

Figure 4:
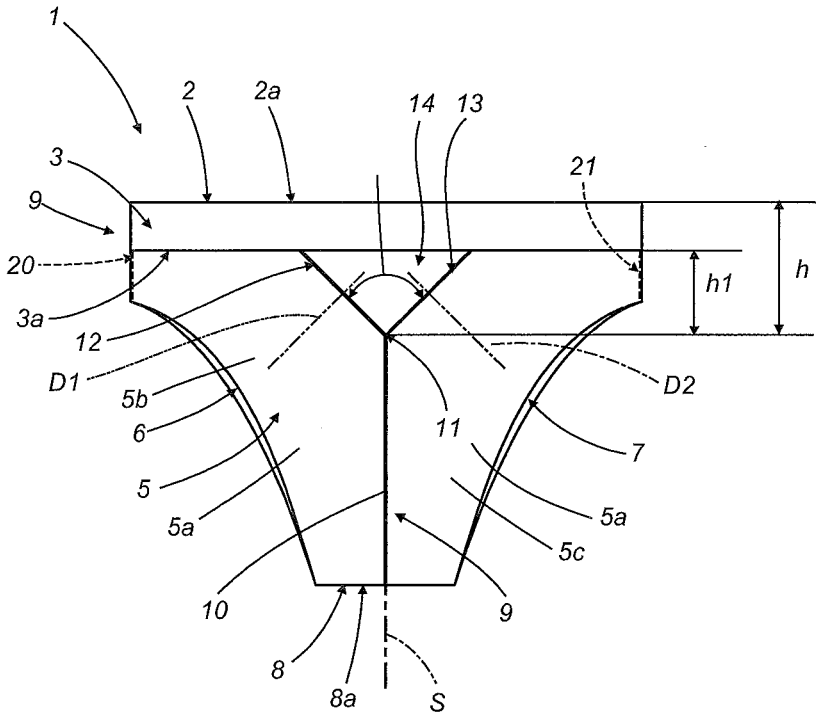
FIG. 4 is a schematic rear view of a fourth embodiment of an undergarment according to this invention.

In FIG. 4 the angle "α" is 90 sexagesimal degrees and the height "h1" is 65 cm.

Figure 5:
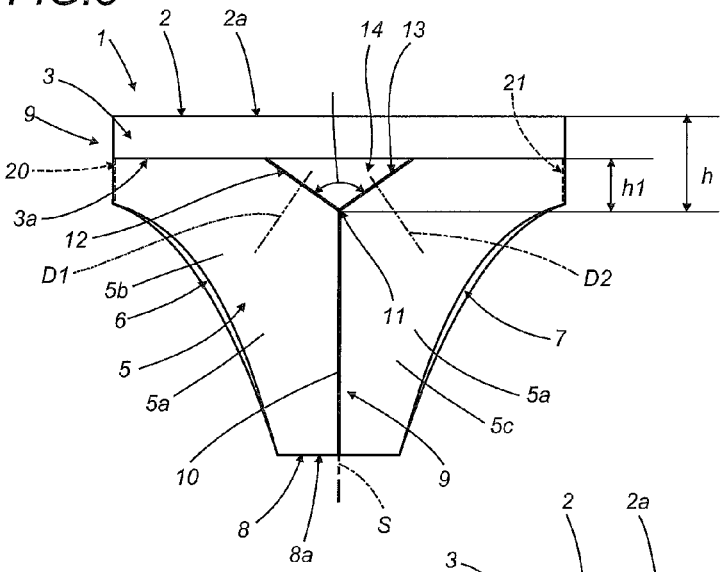
FIG. 5 is a schematic rear view of a fifth embodiment of an undergarment according to this invention.

In FIG. 5 the angle "α" is 110 sexagesimal degrees and the height "h1" is 45 cm.

Figure 6:
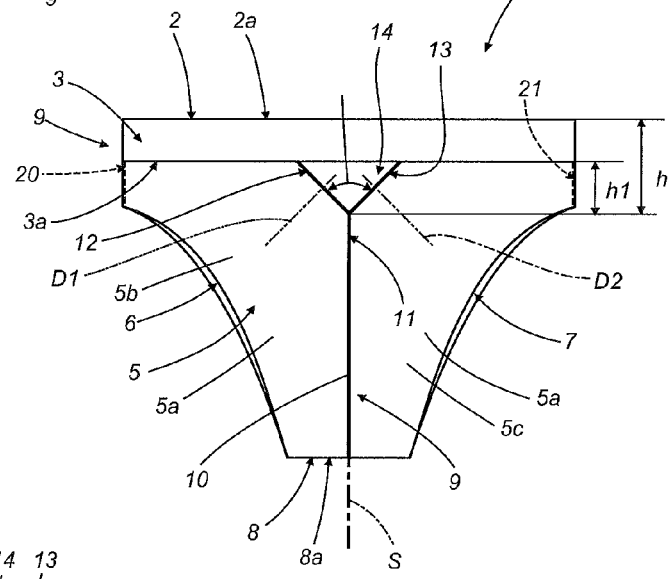
FIG. 6 is a schematic rear view of a sixth embodiment of an undergarment according to this invention.

In FIG. 6 the angle "α" is 90 sexagesimal degrees and the height "h1" is 45 cm.

Figure 7:
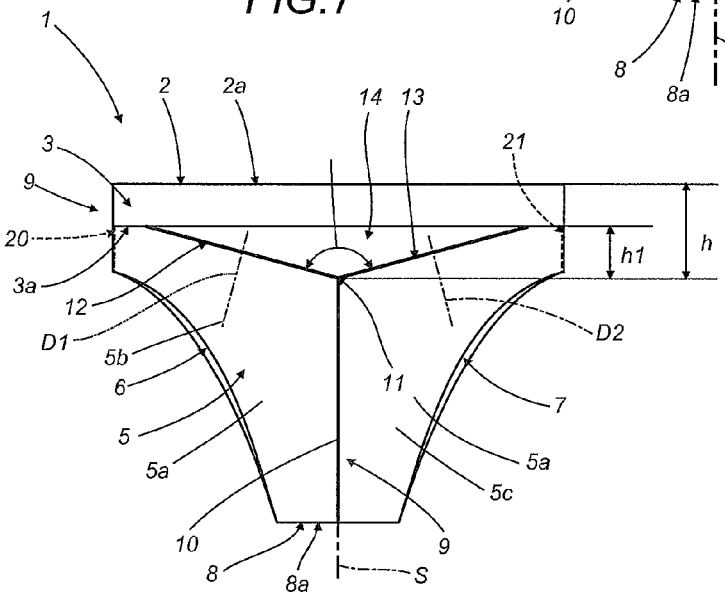
FIG. 7 is a schematic rear view of a seventh embodiment of an undergarment according to this invention.

In FIG. 7 the angle "α" is 150 sexagesimal degrees and the height "h1" is 45 cm.

In further embodiments, the segments 12 and 13 are formed by needlework in such a way that the stretching of the portion 5*a* is interrupted at the segments 12 and 13.

The segments allow differentiated stretching of the rear portion 5*a* to be obtained, thus guaranteeing the desired undergarment 1 wearability.

For example, the needlework at the segments 12 and 13 is cotton.

In another embodiment, the seams 10 and/or 12 and/or 13 are produced by stamping a plastic motif which is stiffer than the fabric of the portion 5*a*.

The invention claimed is:

1. A undergarment comprising an upper portion (2) looped to encircle the waist of a wearer;

a front portion supported by the upper portion (2) and extending downwards from it;

a rear area (5) supported by the upper portion (2) and connected to the front portion, the rear area (5) extending downwards from the upper portion (2), and delimiting, with the front portion, a first and a second opening (6, 7) for the legs of the wearer and comprising at least one portion (5*a*, 5*b*, 5*c*) made of elastic fabric, the undergarment also comprising a lower connecting portion (8*a*) between the front portion (4) and the rear area (5), the lower portion (8*a*) forming the crotch (8) of the undergarment, said undergarment being characterised in that it comprises a system (9) for confining the elastic stretching of the portion (5*a*, 5*b*, 5*c*) made of elastic fabric, the confining system (9) comprising at least one first sector (14) in the rear area (5) where stretching is reduced compared with the portion (5*a*, 5*b*, 5*c*) made of elastic fabric, wherein the confining system (9) comprises at least a first seam (10) extending between the crotch (8) and a node (11) located at a predetermined height "h1" from the lower edge (3*a*) of the elastic element (3) and at a middle section (S) of the rear area (5), and wherein the confining system (9) comprises a second and a third segment or seam (12, 13) extending from the node (11) towards the upper portion (2) for delimiting the first sector (14).

2. The undergarment according to claim 1, characterised in that the first sector (14) is located between the node (11) and the upper portion (2).

3. The undergarment according to claim 1, characterised in that the first sector (14) comprises a fabric whose modulus of elasticity is less than the modulus of elasticity of the portion (5*a*, 5*b*, 5*c*) made of elastic fabric.

4. The undergarment according to claim 1, characterised in that the portion (5*a*, 5*b*, 5*c*) made of elastic fabric comprises a first and a second half-portion (5*b*, 5*c*), the first seam (10) joining the first and the second half-portions (5*b*, 5*c*).

5. The undergarment according to claim 1, characterised in that the height "h1" is greater than or equal to 3 cm and is less than or equal to 12 cm, that is to say:

$$3 \leq h \leq 12.$$

6. The undergarment according to claim 1, characterised in that the confining system (9) comprises at least one segment or seam (12, 13) for delimiting the first sector (14).

7. The undergarment according to claim 1, characterised in that the second and third segments or seams (12, 13) are angularly spaced relative to the middle section (S) of the rear area (5) by the same angle and between them form an angle "α", the segments or seams (12, 13) being straight.

8. The undergarment according to claim 7, characterised in that the angle "α" is greater than or equal to 75 sexagesimal degrees and is less than or equal to 170 sexagesimal degrees, that is to say:

$$75° \leq \alpha \leq 170°.$$

9. The undergarment according to claim 8, characterised in that the angle "α" is greater than or equal to 95 sexagesimal degrees and is less than or equal to 150 sexagesimal degrees, that is to say:

$$95° \leq \alpha \leq 150°.$$

10. The undergarment according to claim 1, characterised in that second and third segments or seams (12, 13) and the upper portion (2) delimit the first sector (14).

11. The undergarment according to claim 1, characterised in that the confining system (9) comprises a first and a second seam (20, 21) for connecting the front portion to the rear area (5).

12. The undergarment according to claim 1, characterised in that the first sector (14) comprises a plurality of seams or needlework making the first sector (14) stiffer than the portion (5*a*, 5*b*, 5*c*) made of elastic fabric.

* * * * *